US010989468B2

(12) United States Patent
Jacob

(10) Patent No.: US 10,989,468 B2
(45) Date of Patent: Apr. 27, 2021

(54) RAPID COOLING DOCK

(71) Applicant: William A. Jacob, Kansas City, MO (US)

(72) Inventor: William J. Jacob, Kansas City, MO (US)

( * ) Notice: Subject to any disclaimer, the term of this patent is extended or adjusted under 35 U.S.C. 154(b) by 146 days.

(21) Appl. No.: 16/210,556

(22) Filed: Dec. 5, 2018

(65) Prior Publication Data

US 2019/0178572 A1 Jun. 13, 2019

Related U.S. Application Data

(63) Continuation-in-part of application No. 15/215,419, filed on Jul. 20, 2016, now Pat. No. 10,180,274.

(60) Provisional application No. 62/194,293, filed on Jul. 20, 2015.

(51) Int. Cl.

| | |
|---|---|
| ***F25D 31/00*** | (2006.01) |
| ***F25D 17/04*** | (2006.01) |
| ***F25D 23/06*** | (2006.01) |
| ***F25C 1/04*** | (2018.01) |
| ***F25D 25/02*** | (2006.01) |
| ***F25D 17/06*** | (2006.01) |
| ***F25D 23/04*** | (2006.01) |
| *F25C 1/24* | (2018.01) |

(52) U.S. Cl.

CPC ..... *F25D 31/007* (2013.01); *F25C 1/04* (2013.01); *F25D 17/045* (2013.01); *F25D 17/062* (2013.01); *F25D 23/04* (2013.01); *F25D 23/061* (2013.01); *F25D 25/024* (2013.01); *F25C 1/24* (2013.01); *F25C 2301/00* (2013.01); *F25D 2317/061* (2013.01); *F25D 2317/063* (2013.01); *F25D 2331/805* (2013.01); *F25D 2400/28* (2013.01); *F25D 2500/02* (2013.01)

(58) Field of Classification Search

CPC .... F25D 31/007; F25D 17/045; F25D 17/062; F25D 23/12; F25D 23/04; F25D 23/061; F25D 25/024; F25D 2317/061; F25D 2317/063; F25D 2331/805; F25D 2331/803; F25D 2331/812; F25D 2500/02; F25C 1/04; F25C 1/24; F25C 2301/00

See application file for complete search history.

(56) References Cited

U.S. PATENT DOCUMENTS

| | | | | |
|---|---|---|---|---|
| 9,182,165 | B2 * | 11/2015 | Lee | F25D 17/02 |
| 2006/0185372 | A1 * | 8/2006 | Conde Hinojosa | A23L 3/36 62/64 |
| 2012/0011881 | A1 * | 1/2012 | Cho | F25D 31/00 62/408 |

* cited by examiner

*Primary Examiner* — Joseph F Trpisovsky

(74) *Attorney, Agent, or Firm* — Mashburn Law Office, LLC; Donna Denise Mashburn Chapman

(57) ABSTRACT

A method of and apparatus for accelerating the cooling of a beverage can and/or ice tray utilizing at least one body that presents a density and thermal conductivity, defines a standard beverage can and/or ice tray receiving receptacle configured to form a minimum contact surface area of engagement with at least one can and/or tray, and preferably further defines a series of thru-holes, so as to promote accelerated cooling through conduction, convection within a compartment.

16 Claims, 14 Drawing Sheets

FIG. 11A
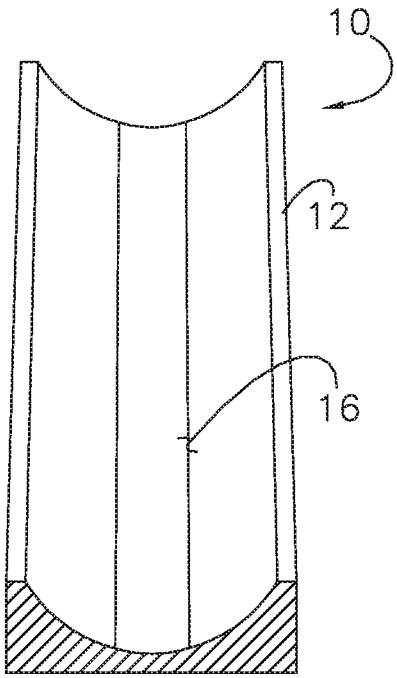
FIG. 11B
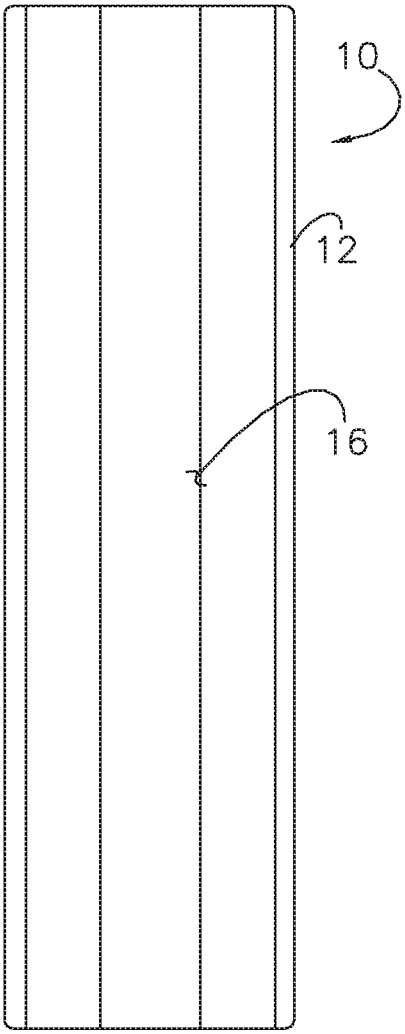
FIG. 11E
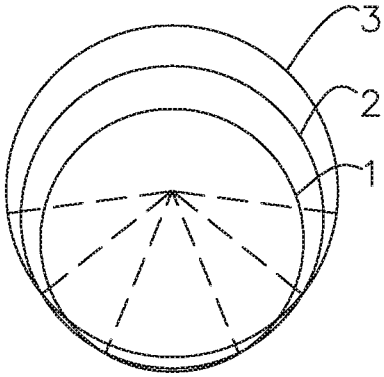
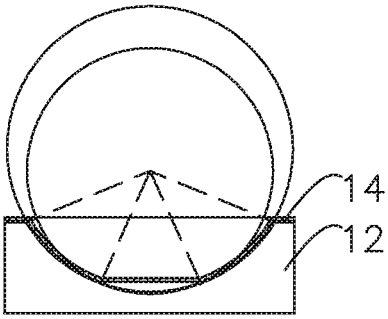
FIG. 11C
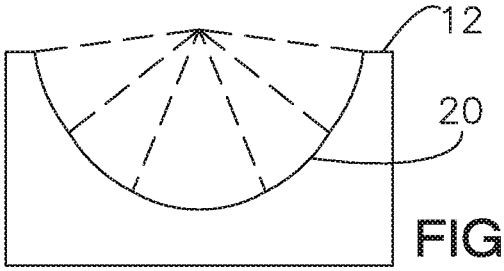
FIG. 11D FIG. 12A
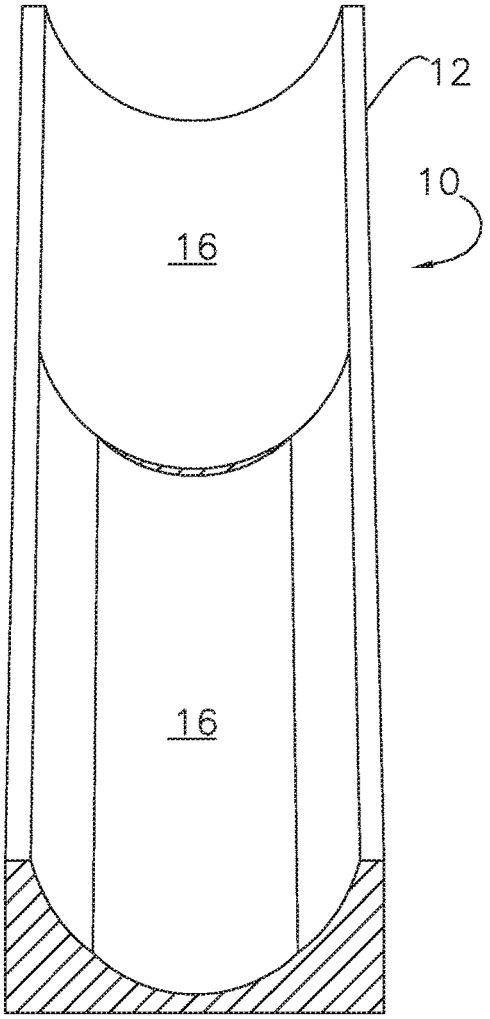
FIG. 12B
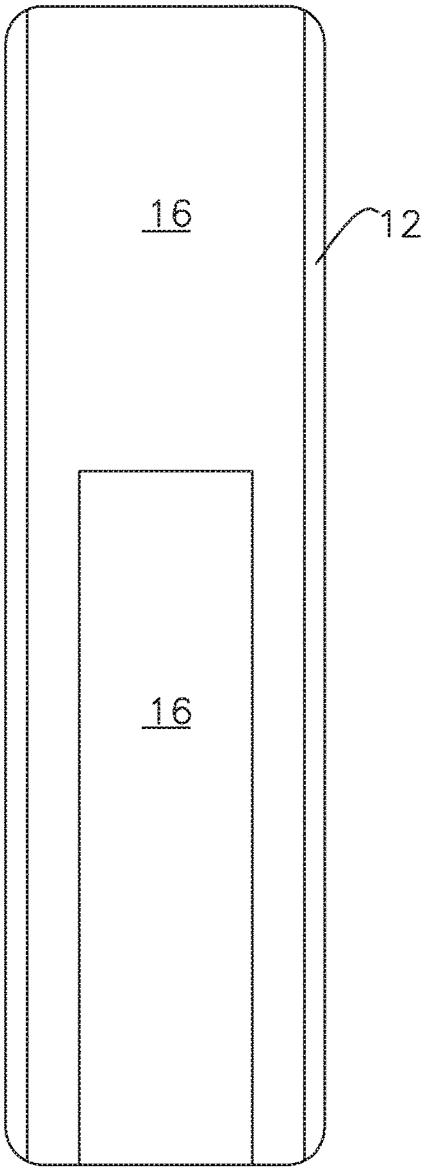
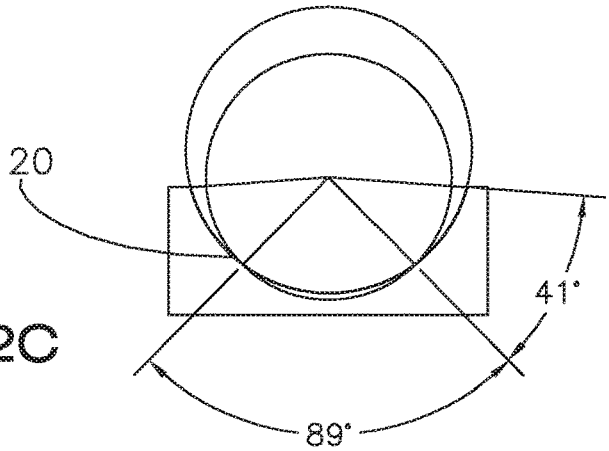
FIG. 12C

RAPID COOLING DOCK

CROSS-REFERENCES TO RELATED APPLICATIONS

This U.S. Non-Provisional patent application is a continuation-in-part from U.S. Ser. No. 15/215,419, currently issued as U.S. Pat. No. 10,180,274, which claims benefit of U.S. Provisional Application Ser. No. 62/194,293 filed on Jul. 20, 2015, and of the same title, said full disclosures being incorporated by reference herein.

BACKGROUND OF THE INVENTION

Field of the Invention

The present invention relates generally to methods of and apparatuses for cooling a liquid in a compartment, such as a commercial or residential freezer; and more particularly, to a method of and apparatus for accelerating cooling that utilizes conduction, convection, and/or radiant heat transfer.

Discussion of Prior Art

Methods of cooling a stand-alone liquid, such as a beverage or water, in a residential or commercial grade freezer has long consisted of simply placing the liquid in a container, and placing the container on a flat surface or rack within the freezer. For example, ice trays have been used to cool water, so as to form ice cubs. Due to minimal contact surface area of engagement between the internal surfaces of the freezer and the container, thermal or radiant heat transfer between the outside surface of the container and its surroundings is the predominate method of conventional heat transfer in such systems. Standard beverage cans such as 1-4 shown in FIG. 1 have long been placed in a refrigerator or freezer in effort to cool the liquid placed therein.

BRIEF SUMMARY OF THE INVENTION

The present invention offers a method of and apparatus for accelerating cooling of a liquid within a freezer that better utilizes conduction, and convection, in addition to conventional radiant heat transfer. The apparatus is preferably formed of a dense, non-reactive, metallic material so as to facilitate conductive heat transfer to a standard, less dense (e.g., aluminum) beverage can, and/or ice tray. The apparatus is configured to increase the contact surface area of engagement with the can and/or tray in comparison to prior art cooling apparatuses, and freezer surfaces. That is to say, the apparatus defines a receptacle that matches at least a portion of the outside profile of the can and/or tray. The apparatus may be a stand-alone dock that is removably placed within a freezer, or it may be integrated with an interior surface (e.g., the bottom floor) of the freezer itself. As such, the invention is useful for cooling aluminum beverage cans and their contents faster than before. By offering more rapid cooling, the invention is further useful for increasing the available storage space in refrigerators, by enabling beverage cans to be stored at room temperature. Where matched with a compatible ice tray, the invention is yet further useful for forming ice cubs faster than conventional ice trays. Lastly, it is appreciated that the dock may be removed from the freezer once cooled, to offer continued cooling as a heat sink outside of the freezer.

The disclosure may be understood more readily by reference to the following description of the drawings, and detailed description of the various features of the disclosure and the examples included therein.

BRIEF DESCRIPTION OF THE SEVERAL VIEWS OF THE DRAWING

A preferred embodiment(s) of the invention is described in detail below with reference to the attached drawing figures of exemplary scale, wherein:

FIGS. 1A-d are prior art elevations and top views of a variety of conventional aluminum beverage cans, wherein can (1), e.g., a standard size Coca-Cola® can, presents an outside diameter of aprx. 2.5 in, and a height of 4.75 in, can (2), e.g., a standard size Red-Bull® can, presents an outside diameter of aprx. 2.25 in, and a height of 5.85 in., can (3) is a standard 15 oz can presenting an outside diameter of 2.5 in, and a height of 5.85 in., and can (4) is a standard 24 oz can presenting an outside diameter of 2.8 in., and height of 7.35 in.;

FIGS. 11A-C are perspective, top planar, and a side elevational view of a rapid chilling dock having a single tray/can receiving receptacle defined in the top surface, wherein the single receptacle is formed of plural radii, for example, a first radius of curvature to match a 12 oz standard can along the outer regions of the profile, and a second central radius of curvature to match a 12 oz thin can;

FIGS. 11D,E are elevations of a dock having a single tray/can receiving receptacle defined in the top surface, wherein the single receptacle is formed by three different radii, for example, a first radius of curvature to match a 24 oz can along the outermost regions of the profile formed by 30 degree angles, a second central radius of curvature to match a 12 oz thin can formed by 45 degree angle, and a third radius of curvature to match a 12 oz standard can along intermediate regions of the profile formed also by 30 degree angles;

FIGS. 12A-C represent a perspective view, top planar, and side or end elevation of a rapid cooling dock having a complex profile comprising outer regions defined by a first radii and 41 degree angles, and an intermediate region defined by a second radii and an 89 degree angle.

DETAILED DESCRIPTION OF THE INVENTION

Figure 1D:
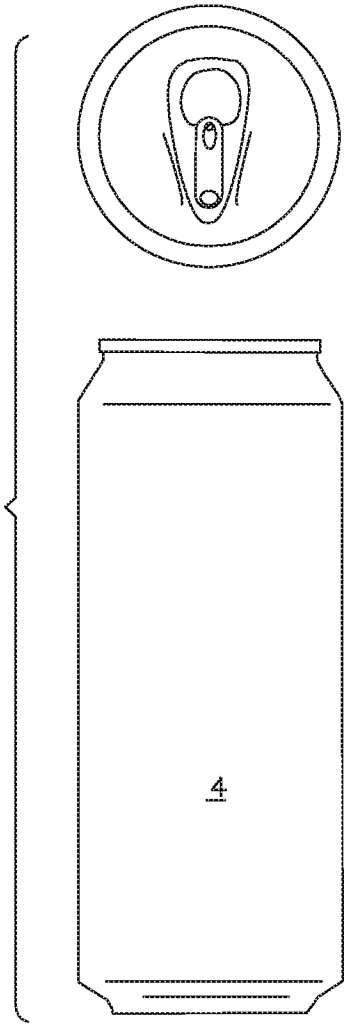
Figure 1C:
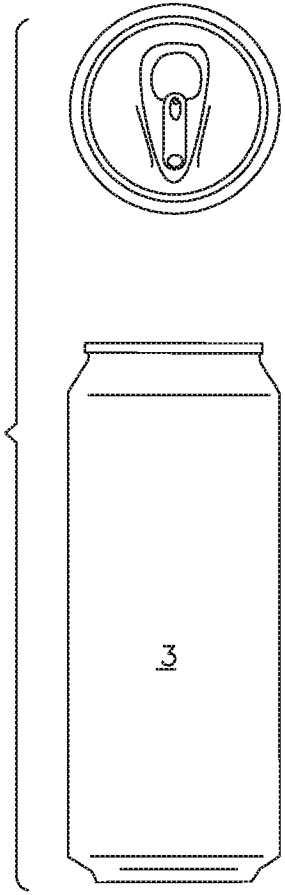
Figure 1B:
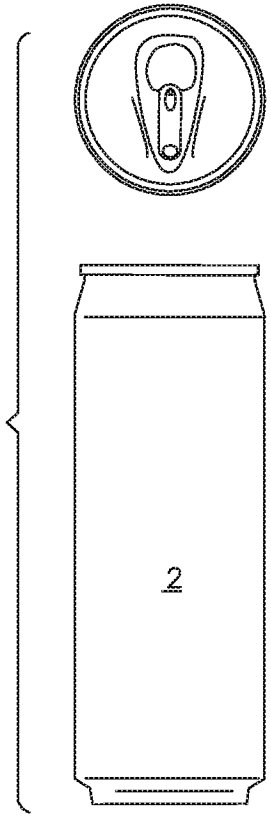
Figure 1A:
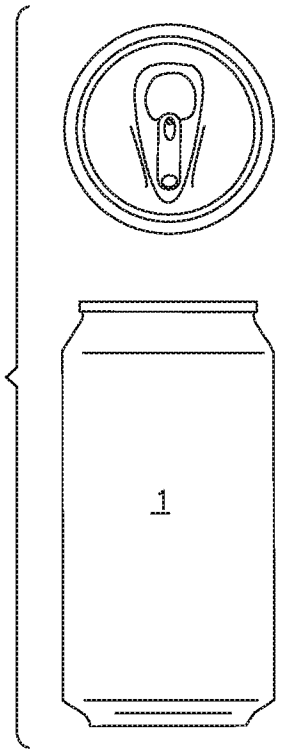
Figure 2:
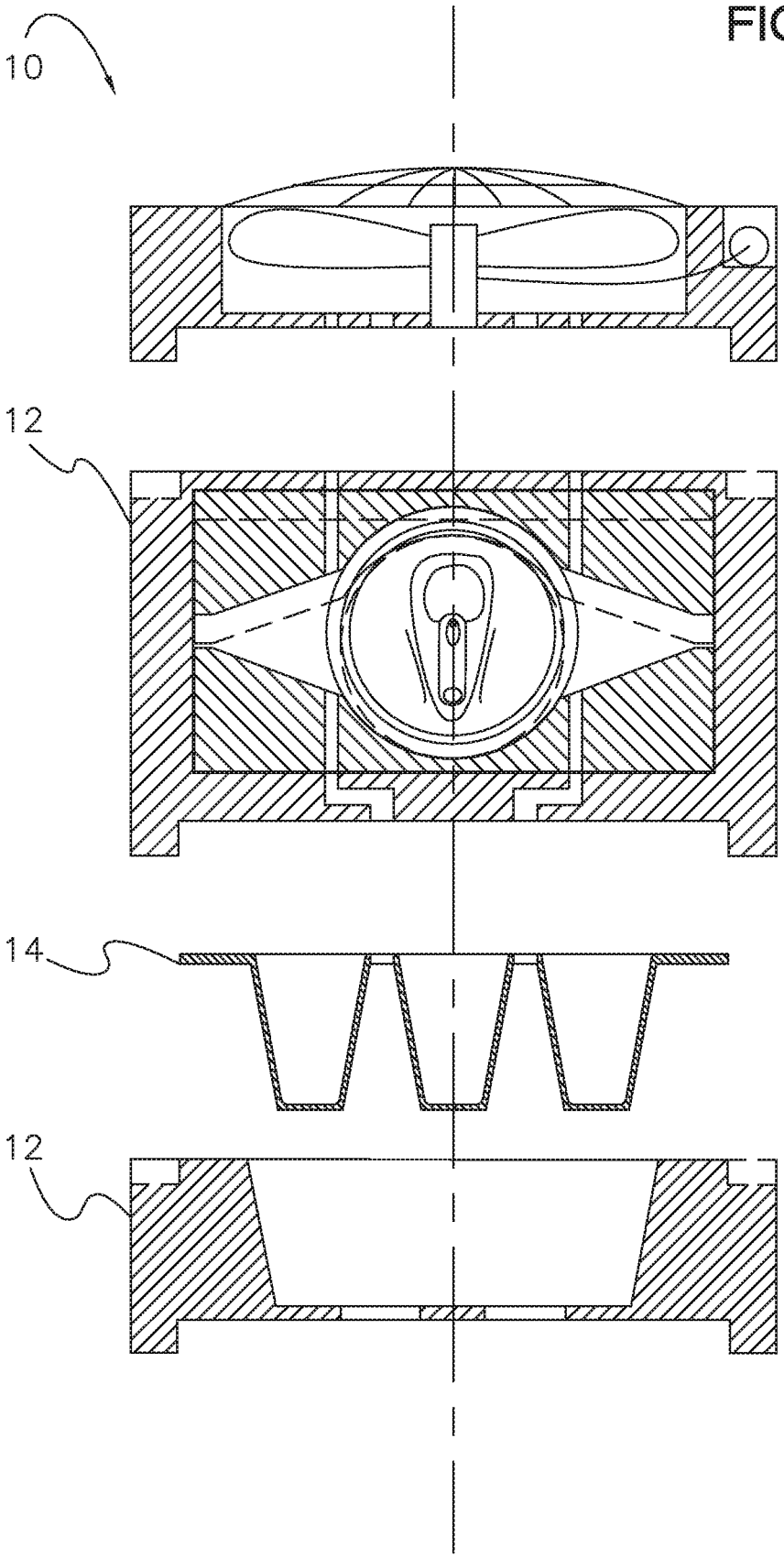
FIG. 2 is an exploded elevation of a rapid cooling assembly comprising stackable individual sections or docks, wherein the sections in this embodiment include a lowermost ice tray dock, a middle can dock, and an uppermost fan section, wherein the number of a particular type of section is at the discretion of the consumer and depends upon such factors as available space, wherein the ice tray dock presents a height and width, and defines a tray receiving receptacle having a depth and sloped side walls, wherein the height, width, depth and sloped walls match the sloped walls of the compatible ice tray shown intermediate the lowermost and middle sections, wherein the middle section comprises articulating can engaging parts operable to engage cans or similar rounded containers of various diameters, wherein each section defines thru-holes through which air is drawn by a low pressure region produced by the fan, in accordance with a preferred embodiment of the invention.
Figure 3:
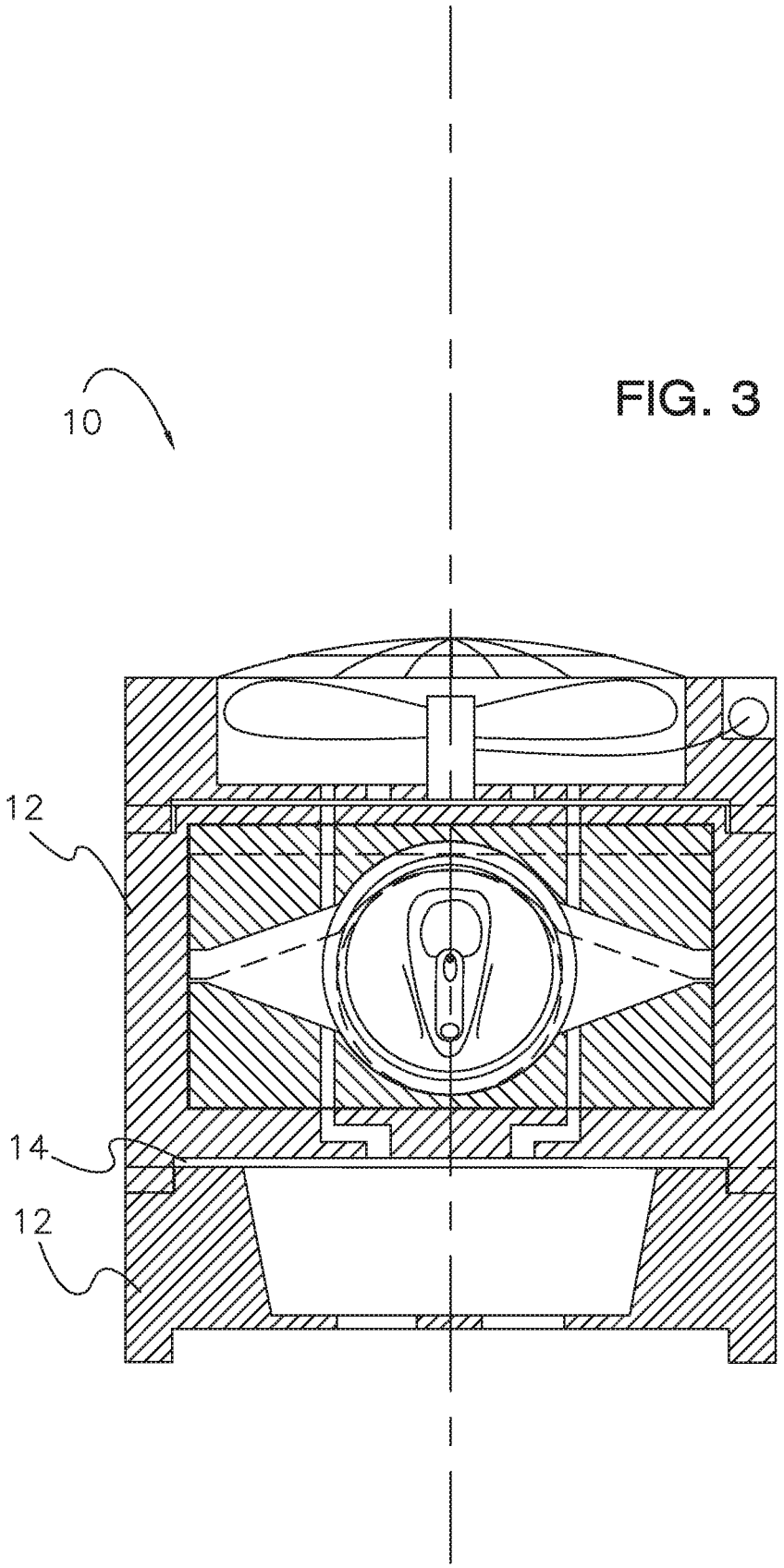
FIG. 3 is a collapsed view of the assembly shown in FIG. 2, particularly illustrating a gap between the middle and lower sections less than the thickness of the tray flange, such that the flange causes the upper sections of the assembly to lift as it is slidably inserted therein.
Figure 4C:
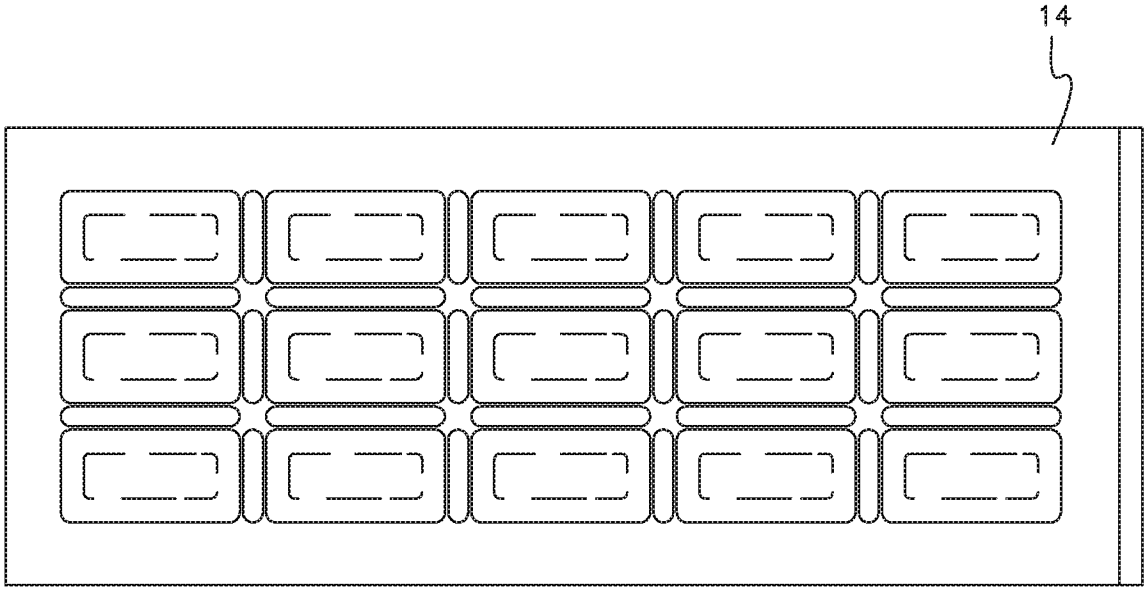
FIGS. 4A-C are front, and side elevations, and a top view of an exemplary ice tray adapted for use with the ice dock shown in FIG. 2, wherein the ice tray defines 15 ice cube receptacles and 22 thru-holes interposed between adjacent receptacles, in accordance with a preferred embodiment of the invention.
Figure 4B:
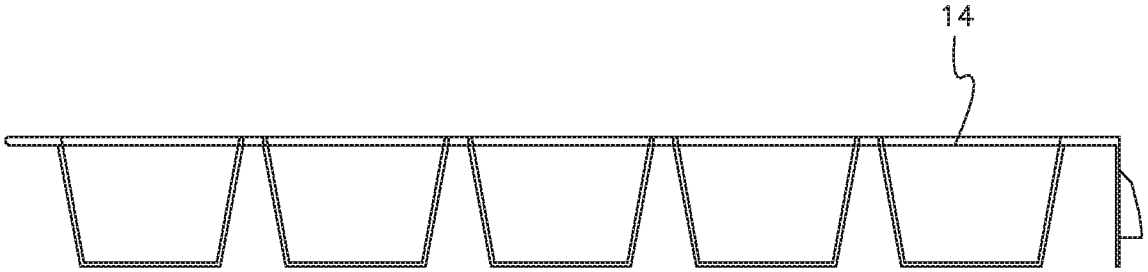
Figure 4A:
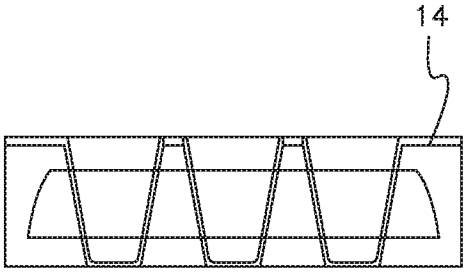
Figures 5A, 5B, 5C, 5D:
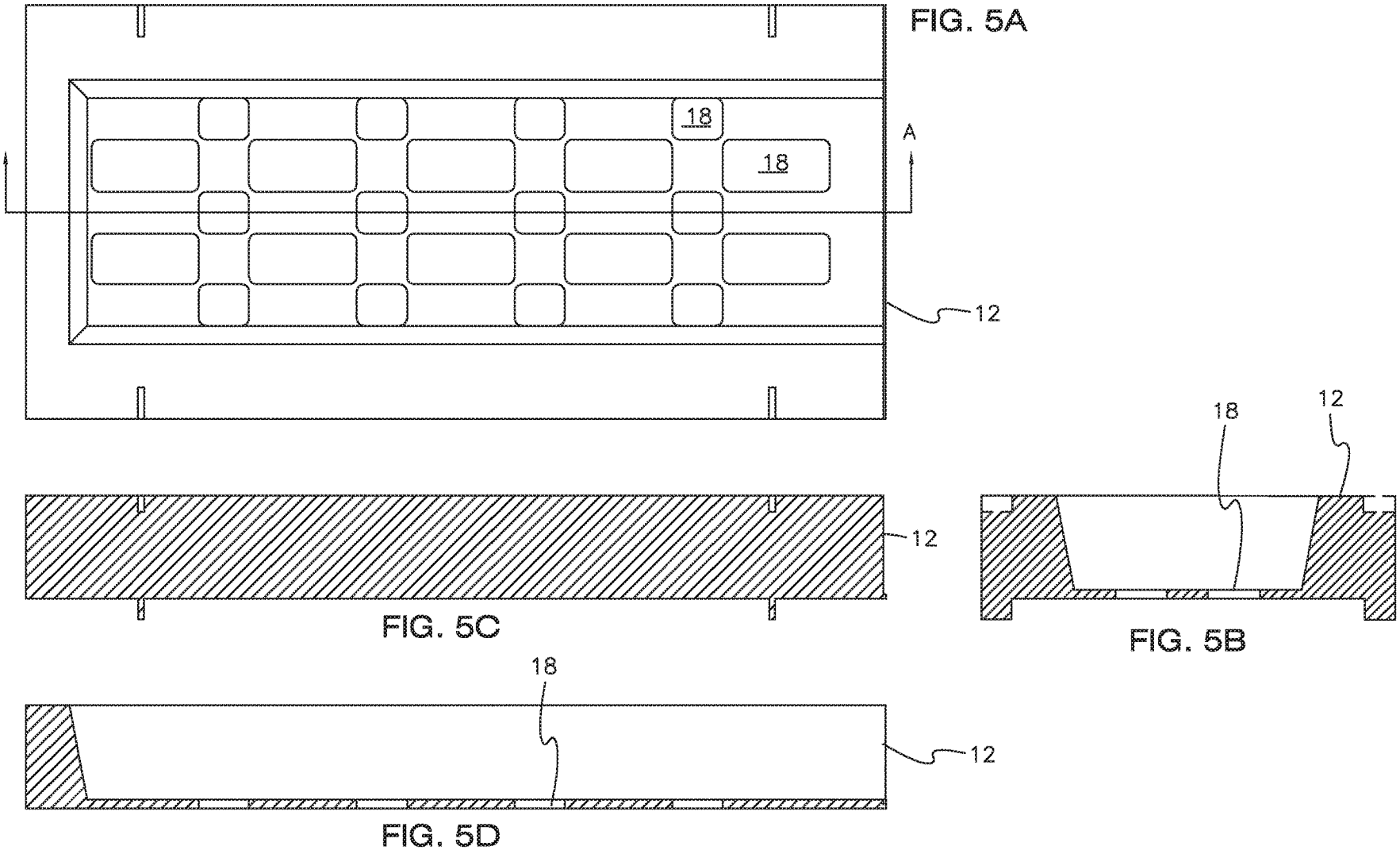
FIGS. 5A-D are front, and side elevations, a top view of the tray dock shown in FIG. 2, and a cross-section taken along the line A shown in FIG. 5A, wherein 22 larger thru-holes are defined corresponding to the hole pattern defined by the tray.
Figure 6A:
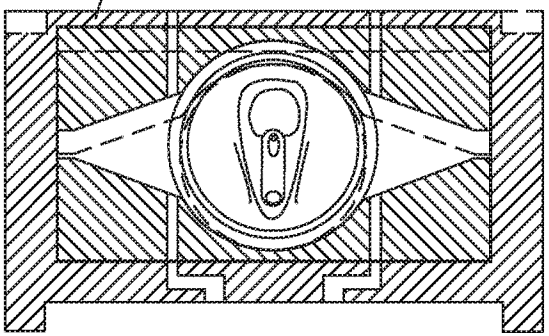
FIGS. 6A-C are front, and side elevations, and a top view of the can dock shown in FIG. 2.
Figure 6B:
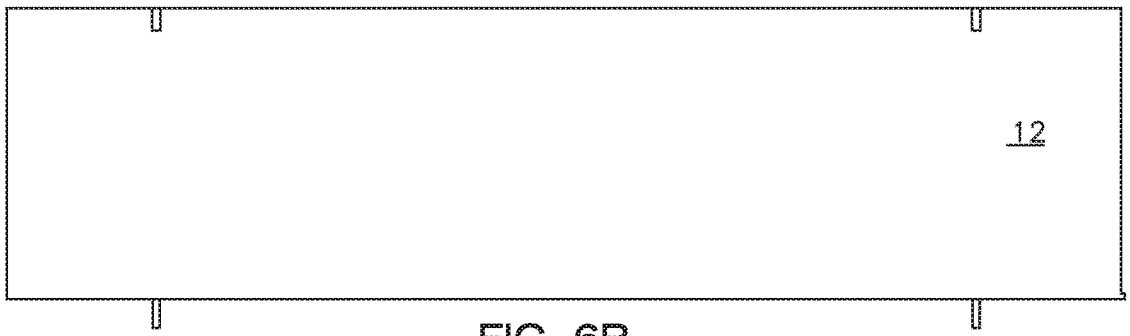
Figure 6C:
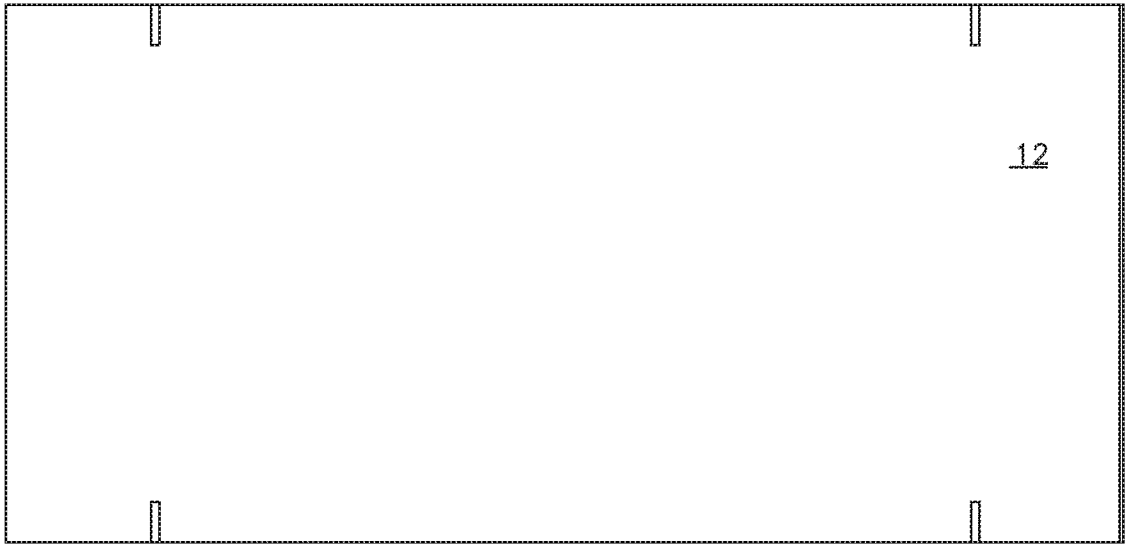

The present invention concerns a method of and apparatus for accelerating the cooling of standard beverage cans (FIG. 1), and/or formation of ice cubes in chilled air enclosed within a compartment, such as defined by a cooling appliance 100, such as a commercial or residential freezer, refrigerator, or cooler, etc. as variously depicted in the illustrated embodiments (FIGS. 1-14). More particularly, the rapid cooling dock 10 includes at least one body 12 that presents a profile configured to form superjacent contact areas of engagement with at least one conventional or standard-size beverage can, and/or an ice tray 14 of suitable configuration. The body(s) 12 and tray 14 are preferably monolithic bodies formed of material suitable for the intended use, such as a non-reactive (non-rusting) metal or alloy. The increased contact surface area of engagement is preferably at least 5 percent, more preferably, at least 10 percent, and most preferably at least 20 percent of the outside surface area of the can or tray 14. As shown in the illustrated embodiments, multiple bodies may be used to engage the cans and tray (FIG. 2-6), or a singular dual purpose dock 10 (FIGS. 7-11E) may be used. It is appreciated that dual singular docks may be used to engage, for example the upper and lower hemispheres of the beverage can.

In operation, the dock 10 is placed in a compartment (e.g., freezer) (not shown) so that its core temperature is caused to lower to that of the air contained in the compartment through conventional refrigeration means understood by those of ordinary skill in the art. The can and/or tray is then placed in a matching receptacle 16 defined by the dock and allowed to cool. Accelerated cooling, in comparison to conventional practices, occurs, because of conduction, and in some embodiments forced convection, in addition to normal heat transfer that would occur in the compartment. To promote conduction the dock is preferably formed of a material offering a predetermined thermal conductivity, and mass, such as a metal (e.g., aluminum, aluminum alloy, or more preferably, steel). It is appreciated that the tray may be, likewise, formed of a thermally conductive metal, such as aluminum. The body is preferably treated to prevent rust, corrosion, and other deleterious effects from being placed and stored within the compartment. It is appreciated that other metals offering greater thermal conductivity, corrosive resistance, and/or durability may be used. To promote convection along the side walls of the ice cube receptacles and/or can one or more through holes 18 are preferably defined by the dock, and configured to direct air flow along these areas. In a preferred embodiment, the ice tray defines a flat lowermost region that, in addition to offering stability when not used with the dock, further allows chilled air to flow beneath and adjacent the ice cube receptacles. The dock 10 and tray 14 preferably present chamfered and/or filleted edges so as to facilitate handling, and placement/removal of adjacent items in the freezer.

In an example, the dock may present a width of approximately 8 cm, a maximum height of approximately 3 cm, and a length of approximately 20 cm, so as to facilitate manual handling (e.g., removing from and placement within a freezer, etc.).

The dock 10 has been described as a stand-alone item. Alternatively, it is appreciated that the dock 10 may be integrated with a fixture or otherwise compartment defining surface, for example, a fixed or pull-out shelf, bin, drawer, or the lower floor of a cooling appliance, such as a cooler, merchandiser, freezer, refrigerator, etc. The dock may be uniformly constructed therewith or may be affixed thereto, such that the receptacle composes an inner surface of the compartment. The refrigerator or freezer may be a stand-alone or a walk-in type, and may be commercial or residential. In such permanent configurations, it is appreciated that the extents and mass of the dock may be drastically increased by tying it into the framework or structure of the appliance itself, thereby, enabling multiple dedicated receptacles, and providing greater heat sink ability.

More particularly, the invention includes a rapid cooling dock adapted for use within chilled air encased, enclosed, or otherwise conditioned within a compartment, and for accelerating the cooling of a standard beverage can, wherein the air presents an average temperature less than room temperature. Conventional residential freezer, refrigerator achievable temperatures are suitable for use herein. The can presents an outside surface area, including the side walls, bottom and top caps. The can and the air cooperatively produce a first heat transfer rate from the can and to the air when the can is placed within the air conventionally.

The dock 10 comprises at least one body 12 defining a first surface. The body is generally illustrated as an elongated rectangular cube, with the first surface being a coplanar top surface; however, it is well within the ambit of the invention to use bodies of differing configuration. The first surface defines at least one receptacle 16 for receiving the can and/or ice tray 14. The receptacle 16 is cooperatively configured with the can (e.g., present generally congruent radii of curvature, wherein the "generally" equals, for example, within 3% of each other) to present a contact surface area of engagement with at least 5 percent, more preferably at least 10 percent, and most preferably at least 20 percent of the outside surface area of the can ("outside can surface area") when the can is placed within the receptacle and the receptacle has been caused to achieve the average temperature of the encased air.

The preferred body presents a mass, density, composition, and thermal conductivity that causes heat transfer from the can and to said at least one body at a second heat transfer rate greater than, more preferably 25 percent greater than, and most preferably 50 percent greater than the first heat transfer rate when the can is placed within the receptacle 16 and said at least one body 12 is at the average temperature.

More preferably, where the can is formed in part by a sidewall having a width, and presents a cylinder defined by a first radius and a first length, the receptacle 16 defines a concavity defined by a second radius generally equal to the first radius plus the width of the sidewall and a second length greater than the first length.

Figure 7C:
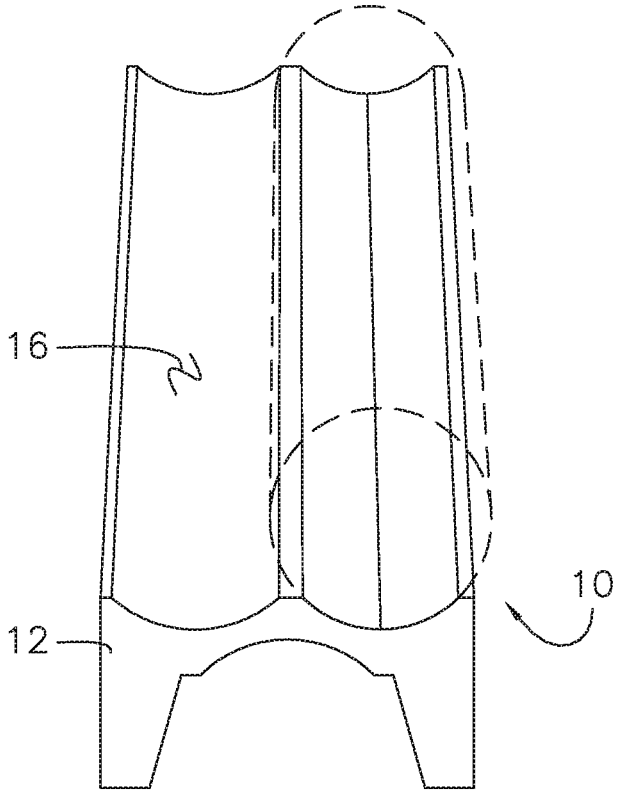
FIG. 7C is a bottom perspective view of the dock shown in FIG. 7, particularly illustrating second and third can receiving receptacles, each having a different radius of curvature than the other two, so as to facilitate engagement with cans of 3 different sizes.
Figure 7A:
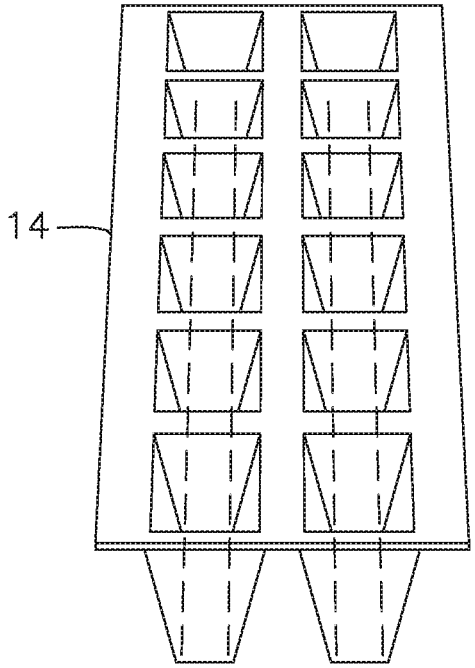
FIG. 7A is a top perspective view of an ice tray adapted for use with the dock shown in FIG. 7.
Figure 7B:
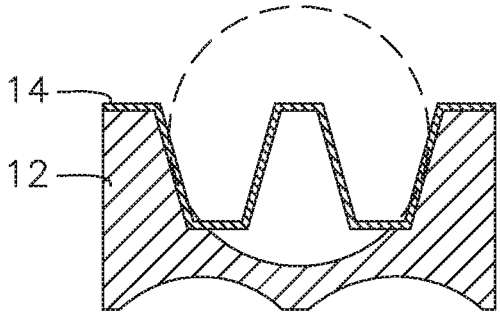
FIG. 7B is a cross-sectional elevation of the dock of FIG. 7, tray of FIG. 7A disposed therein, and can.
Figure 7:
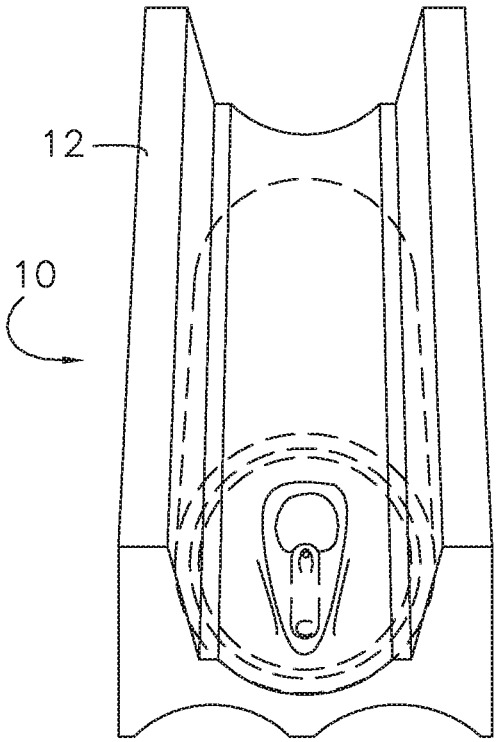
FIG. 7 is a top perspective view of a rapid cooling dock with a superimposed aluminum beverage can disposed therein, wherein the dock defines a curvilinear surface having the same radius of curvature as a standard size can, and sloped walls congruent with the sloped walls and depth of a compatible ice tray, in accordance with a preferred embodiment of the invention.
Figure 8C:
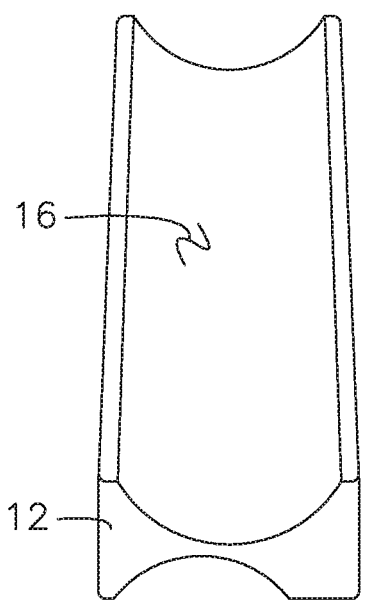
FIGS. 8A-D are perspective views of a rapid cooling dock having opposite can-engaging receptacles, and a compatible ice tray and beverage can superimposed therein, wherein a first receptacle runs the full length of the dock and has a first radius equal, for example, to that of a 24 oz can, wherein second and third receptacles are formed in a stair-cased configuration within the opposite surface of the dock, and define radii of curvature smaller than the first, and equal, for example, to that of a 12 oz standard can and a 12 oz thin can, and wherein the ice tray is configured to form superjacent layers with the first receptacle, in accordance with a preferred embodiment of the invention.
Figure 8A:
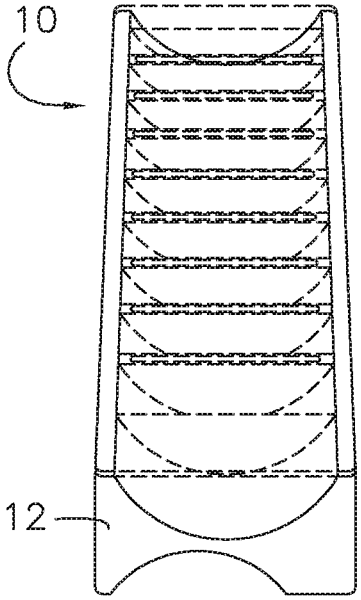
Figure 8D:
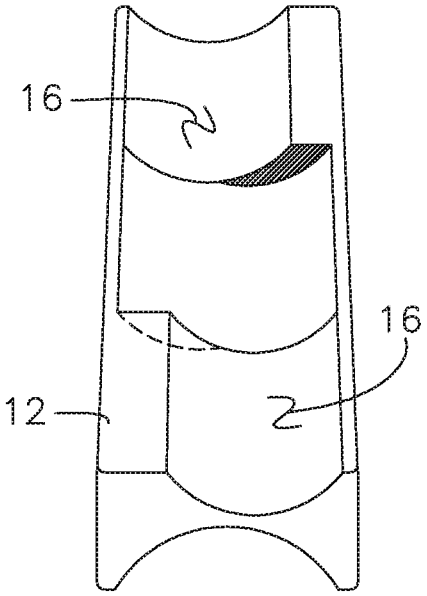
Figure 8B:
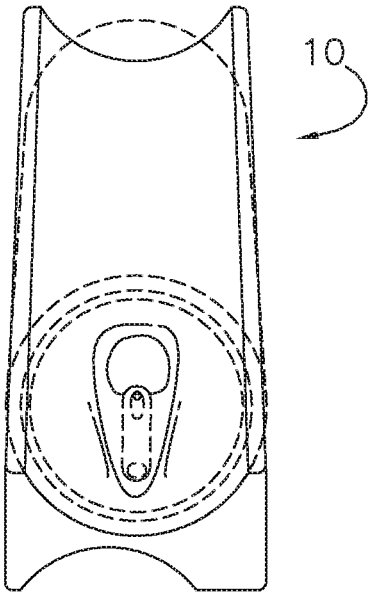
Figure 9B:
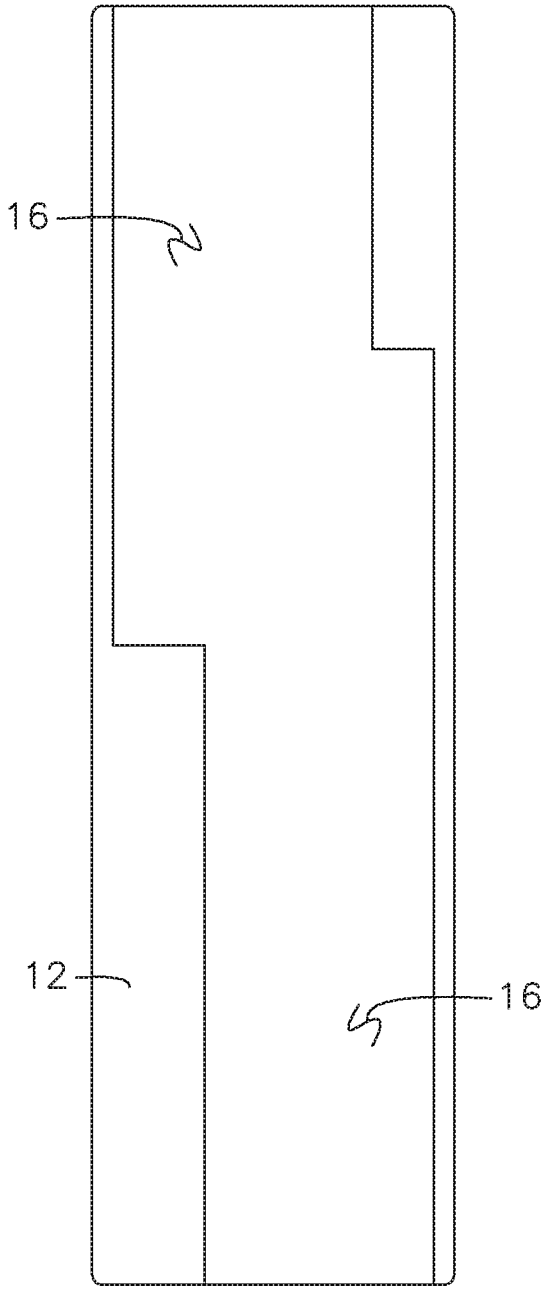
FIGS. 9A,B are plan views of the top and bottom surfaces of the dock shown in FIGS. 8A-D.
Figure 9A:
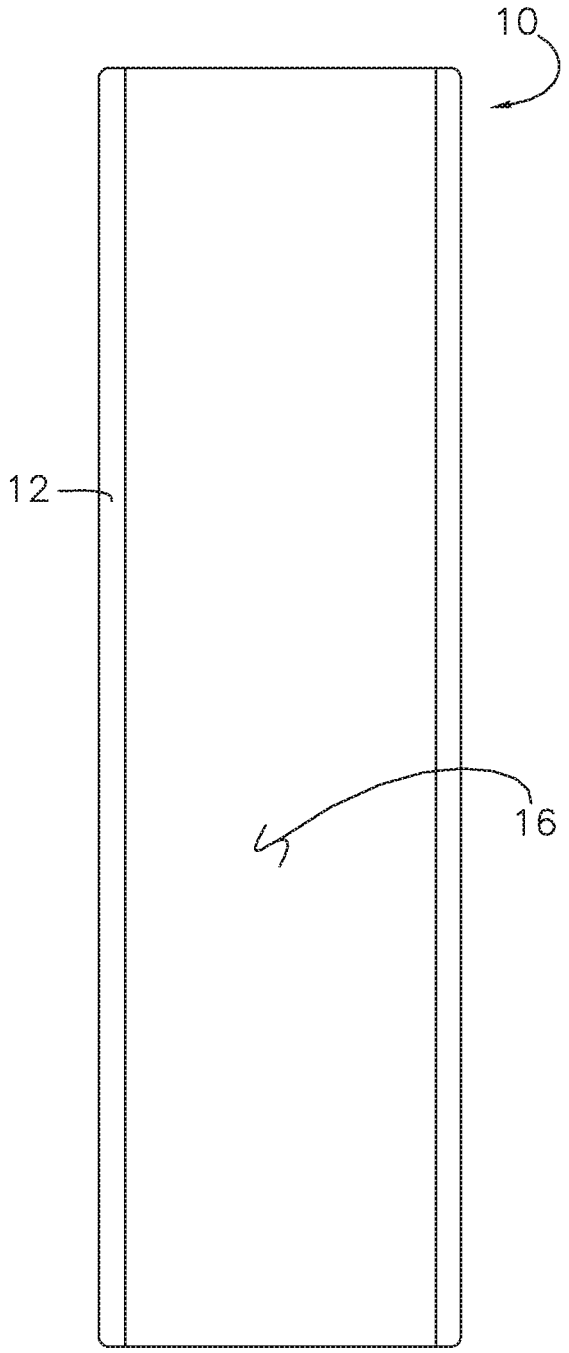
Figure 10A:
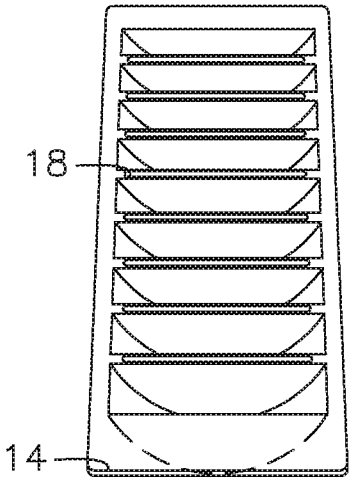
FIGS. 10A-C are perspective, side elevation, and top planar views of the ice tray shown in FIGS. 8A-D, particularly illustrating 9 ice cube receptacles, 8 thru-holes intermediate the receptacles, and extended longitudinal flanges for handling, wherein each ice cube receptacle matches the depth and profile of the first can receptacle defined by the dock, and more preferably, defines a flat central region at the bottom to promote stability when placed upon a flat surface, in accordance with a preferred embodiment of the invention.
Figure 10B:
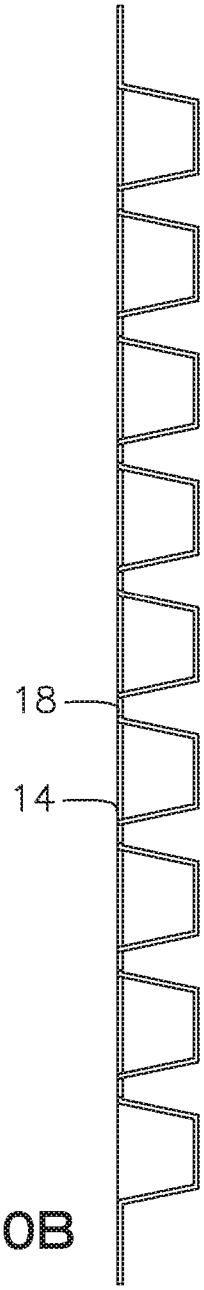
Figure 10C:
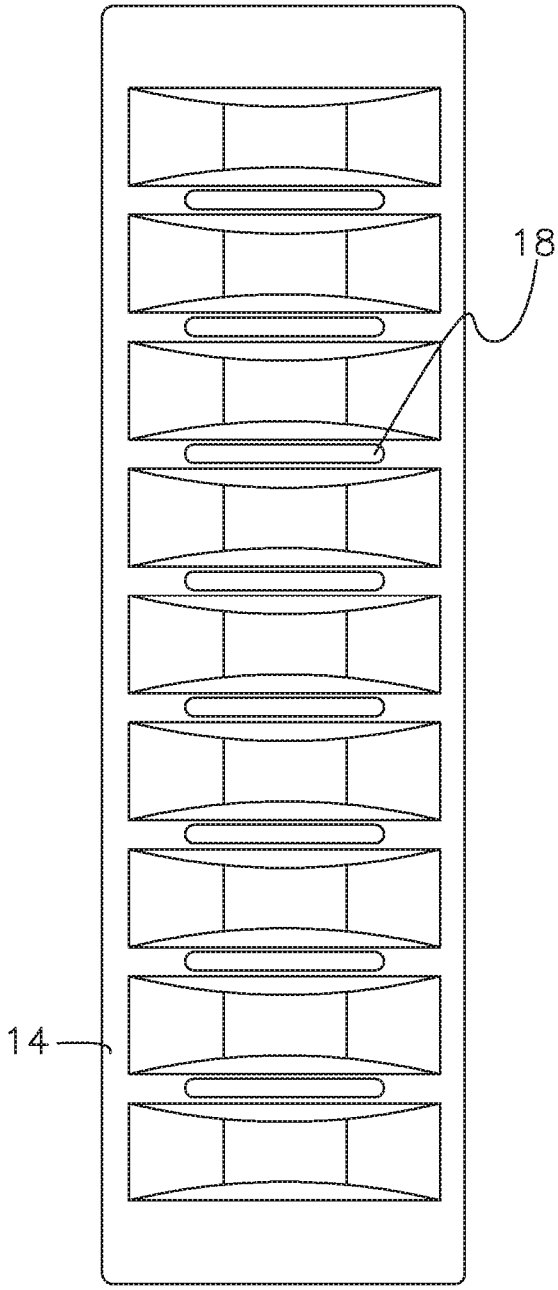
Figure 10D:
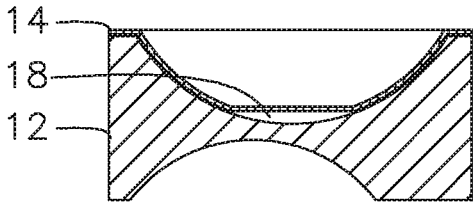
FIG. 10D is a cross-sectional elevation of a tray having a flat region, and the ice dock shown in FIGS. 8A-D.

More preferably, and as shown in FIGS. 7-9, the at least one body 12 defines first and second receptacles 16 configured to engage first and second cans having differing radii and/or lengths (FIG. 1). The first and second receptacles 16 may be defined within the first surface; or where the at least one body 12 defines first and second opposite surfaces, the first and second receptacles 16 are defined in the first and second opposite surfaces, respectively.

Figure 13:
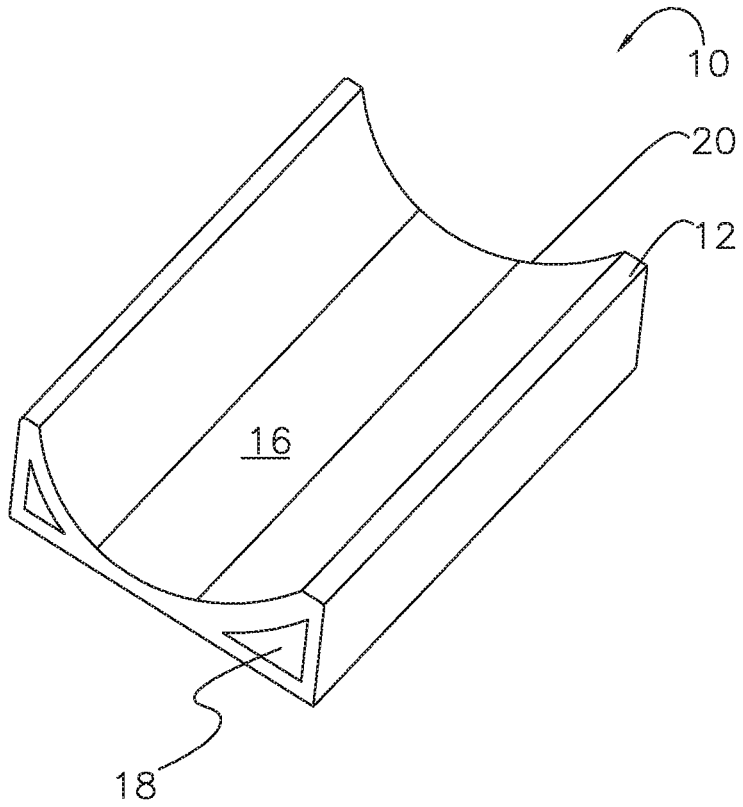
FIG. 13 is a perspective view of a rapid cooling dock comprising a complex profile, wherein the dock is formed via an extrusion process.
Figure 14:
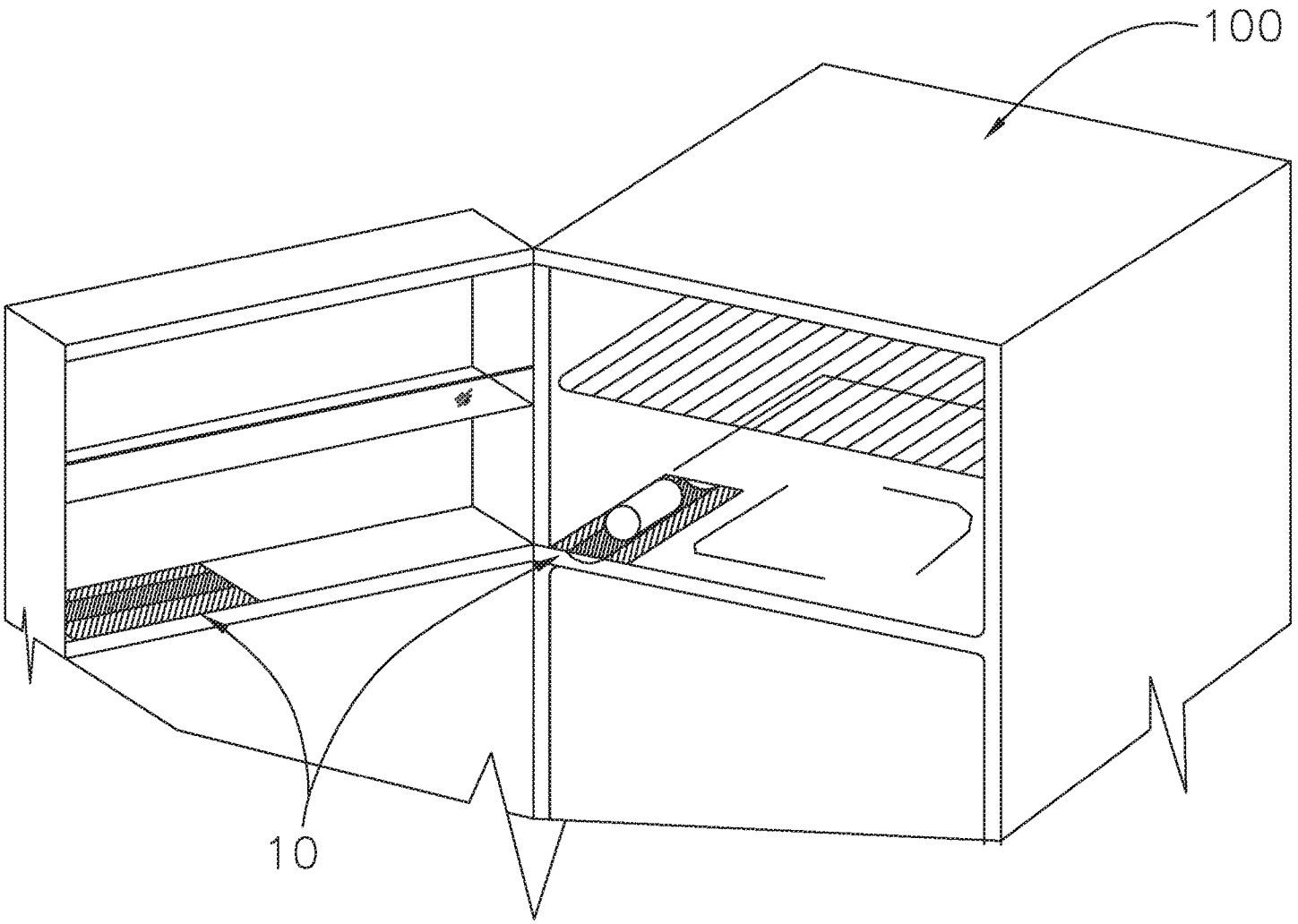
FIG. 14 is a cooling appliance comprising a plurality of cooling dock.

In a preferred embodiment, the receptacle 16 defines a complex profile 20 (e.g., FIG. 11-13). The profile 20 is cooperatively configured with multiple standard beverage cans having differing radii, so as to present a contact surface area of engagement with at least 5 percent of the outside surface area of each can, when either can is placed within the receptacle 16 at any one time, and where length allows, concurrently. In yet another embodiment, the at least one body 12 may further define an array of cups (not shown) configured to form ice cubes at an accelerated rate, when the dock is placed within the air, so as to be caused to achieve the temperature, and a liquid is placed therein after the dock has achieved the temperature. That is to say, the dock 10 may define an array of cups for forming ice within the profile itself, such that the dock and ice tray are combined into a single, integral body.

This invention has been described with reference to exemplary embodiments; it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to a particular embodiment disclosed as the best mode contemplated for carrying out this invention, but that the invention will include all embodiments falling within the scope of the appended claims.

What is claimed is:

1. A refrigerator defining a compartment, producing chilled air encased within the compartment, and adapted for accelerating the cooling of a first standard beverage can comprising a continuous sidewall, wherein the air presents an average temperature, the sidewall presents an outside surface area, and the can and the air cooperatively produce a first heat transfer rate from the can and to the air when the can is placed within the air, said refrigerator comprising:

a fixture internal to the compartment;

a rapid cooling dock fixedly coupled to the fixture, and adapted for use within the air, said dock presenting at least one body having a first discontinuous surface, said first surface defining a first receptacle, said receptacle being open, so as to enable the lateral placement and removal of the can, and said receptacle being cooperatively configured with the sidewall to present a contact surface area of engagement with at least five percent of the outside surface area when the can is placed within the receptacle, said at least one body presenting a mass, density, and thermal conductivity operable to cause heat transfer from the can and to said at least one body at a second heat transfer rate greater than the first heat transfer rate when the can is placed within the receptacle and said at least one body is at the average temperature.

2. The refrigerator as claimed in claim 1, wherein the second heat transfer rate is at least fifty percent greater than the first heat transfer rate.

3. The refrigerator as claimed in claim 1, wherein the sidewall presents a width, the can presents a cylinder defined by a first radius and a first length, and the receptacle defines a concavity defined by a second radius generally equal to the first radius plus the width of the sidewall and a second length greater than the first length.

4. The refrigerator as claimed in claim 1, wherein the contact surface area of engagement is with at least ten percent of the outside surface area of the can, when the can is placed within the receptacle.

5. The refrigerator as claimed in claim 1, wherein the contact surface area of engagement is with at least 20 percent of the outside surface area of the sidewall, when the can is placed within the receptacle.

6. The refrigerator as claimed in claim 1, wherein said at least one body is formed of a metallic material.

7. The refrigerator as claimed in claim 6, wherein said at least one body is formed of aluminum or an aluminum alloy.

8. The refrigerator as claimed in claim 6, wherein said at least one body is formed of steel.

9. The refrigerator as claimed in claim 6, wherein said at least one body is treated to prevent rust.

10. The refrigerator as claimed in claim 1, wherein the fixture comprises a door shelf, fixed shelf, or door bin, and the dock is integrated with and cooperatively defines a surface of the door shelf, fixed shelf, or bin.

11. The refrigerator as claimed in claim 1, wherein the fixture comprises a pull-out shelf or pull-out drawer, and the dock is integrated with and cooperatively defines the pull-out shelf or pull-out drawer, so as to be removable therewith.

12. The refrigerator as claimed in claim 1, wherein said at least one body further defines a second receptacle, wherein said first and second receptacles are configured to engage first and second cans comprising sidewalls having differing radii, outside surface areas, and/or lengths respectively, and said first and second receptacles are each configured to form a contact surface area of engagement with at least five percent of the outside surface area of the respective sidewall.

13. The refrigerator as claimed in claim 12, wherein said first and second receptacles are defined within the first surface.

14. The refrigerator as claimed in claim 1, said receptacle defining a complex profile, wherein said profile is cooperatively configured with multiple standard beverage cans having differing radii, so as to present a contact surface area of engagement with at least five percent of the outside surface area of each of said cans, when said each of said cans is placed within the receptacle.

15. The refrigerator as claimed in claim 1, wherein said at least one body further defines an array of cups configured to form ice cubes at an accelerated rate, when the dock is placed within the air, so as to be caused to achieve the temperature, and a liquid is placed therein after the dock has achieved the temperature.

16. A cooling appliance defining a compartment, producing chilled air encased within the compartment, and adapted for accelerating the cooling of a standard beverage can comprising a continuous sidewall, wherein the air presents an average temperature, the sidewall presents an outside surface area, and the can and the air cooperatively produce a first heat transfer rate from the can and to the air when the can is placed within the air, said appliance comprising:

a fixture internal to the compartment;

a rapid cooling dock fixedly coupled to the fixture, and adapted for use within the air, said dock presenting at least one body having a first discontinuous surface, said first surface defining a first receptacle, said first receptacle being open, so as to enable the lateral placement and removal of the can, and said first receptacle being cooperatively configured with the sidewall to present a contact surface area of engagement with at least five percent of the outside surface area when the can is placed within said first receptacle, said at least one body presenting a mass, density, and thermal conductivity operable to cause heat transfer from the can and to said at least one body at a second heat transfer rate greater than the first heat transfer rate when the can is placed within the receptacle and said at least one body is at the average temperature, wherein said at least one body further defines a second receptacle, wherein said first and second receptacles are configured to engage first and second cans comprising sidewalls having differing radii, outside surface areas, and/or lengths respectively, and said first and second receptacles are each configured to form a contact surface area of engagement with at least five percent of the outside surface area of the respective sidewall.

* * * * *